United States Patent [19]

Suchomel

[11] 4,455,183

[45] Jun. 19, 1984

[54] PRODUCING POKERWORK DESIGNS ON WOOD SUBSTRATES

[76] Inventor: George Suchomel, 1416 Rometown Dr., Mississauga, Ontario, Canada, L5E 2T4

[21] Appl. No.: 315,215

[22] Filed: Oct. 26, 1981

Related U.S. Application Data

[63] Continuation of Ser. No. 089,987, Oct. 31, 1979, abandoned, which is a continuation of Ser. No. 937,576, Aug. 28, 1978, abandoned.

[30] Foreign Application Priority Data

Nov. 10, 1977 [CA] Canada ..... 260609

[51] Int. Cl.[3] ..... B27M 1/06

[52] U.S. Cl. ..... 156/219; 144/358; 156/277; 428/904.4

[58] Field of Search ..... 264/327; 156/282, 277, 156/59, 209, 219, 220; 144/309 A, 309 F, 327, 328, 358; 101/32, 8, 9, 10; 428/904.4

[56] References Cited

U.S. PATENT DOCUMENTS

| | | | |
|---|---|---|---|
| 695,417 | 3/1902 | Schirm | 144/327 |
| 1,566,985 | 12/1925 | Shuler | 144/327 |
| 3,294,014 | 12/1966 | Kneisel | 101/8 |
| 4,227,558 | 10/1980 | Bates | 144/327 |

FOREIGN PATENT DOCUMENTS

| | | | |
|---|---|---|---|
| 89494 | 3/1896 | Fed. Rep. of Germany | 144/328 |

*Primary Examiner*—Henry F. Epstein
*Attorney, Agent, or Firm*—Ridout & Maybee

[57] ABSTRACT

Improved pokerwork type designs on wood veneers are obtained by laminating the veneer to a thin paper, fabric or foil substrate, and applying the design by means of a heated printing plate interacting with a cooled platen of highly heat conductive metal.

4 Claims, 3 Drawing Figures

PRODUCING POKERWORK DESIGNS ON WOOD SUBSTRATES

This is a continuation of application Ser. No. 89,987, filed Oct. 31, 1979 and now abandoned, which is a continuation of application Ser. No. 937,576, filed Aug. 28, 1978 and now abandoned.

This invention relates to the production of pokerwork designs on thin wood substrates.

It is known to produce pokerwork designs on thin wooden substrates, for example rectangles of wood veneer of postcard size, by burning in the design in a printing press using a heated printing plate. The resulting products have not been altogether satisfactory. The wooden substrate must be relatively thick, compared for example to a normal postcard, in order both to prevent the design from burning through, and to prevent ink from writing or printing on the back of the card from penetrating through to the design. Fine detail cannot be reproduced properly, and the resulting product is very easily split or broken and is hardly strong enough to withstand normal postal handling.

We have now found a means of producing such designs which can overcome these problems, producing a thinner, stronger product on which highly detailed designs can be properly reproduced and which is better adapted for correspondence purposes when produced as a postcard.

According to the invention, a method of producing a pokerwork design upon a wood veneer comprises laminating one surface of the veneer onto a thin substrate of paper, fabric or foil, and impressing the other surface of the veneer with a desired design in a press having a printing plate mounted on and in close thermal contact with a bed of substantial thermal capacity heated to a temperature above the carbonization temperature of the wood, whereby the design on the plate is burnt onto the veneer, and a cold platen of high thermal conductivity. Although at low rates of production it may be possible for heat to dissipate from the platen sufficiently rapidly to prevent its temperature from rising substantially, some form of forced cooling, for example by water circualtion, will be required at higher rates of production. The highly conductive cold platen prevents the temperature of the substrate and the under surface of the veneer from rising substantially during the printing step and thus prevents the design on the printing plate from burning through the laminate and limits the depth to which it is burnt into the wood: in addition, there is less lateral spreading of the burning effect, thus preserving detail in the denser parts of the design, and detail in the less dense portions of the design can be adequately burnt in without danger of overburning the denser portions. These improvements make it possible to obtain a much wider range of tonal gradation and considerably finer detail than was hitherto possible.

It is also found that the substrate, quite apart from strengthening the veneer and increasing its resistance to splitting, can provide the product with the unusual property that, even if it does become creased so as to split the veneer layer, the crease remains almost or completely invisible for so long as the card is flat. This is in contrast to conventional picture postcards, in which creasing tends to cause serious disfigurement of the pictorial matter.

The invention also extends to pokerwork prints such as are produced by the method of the invention.

The invention is described further with reference to the accompanying drawings, in which.

Figure 1:
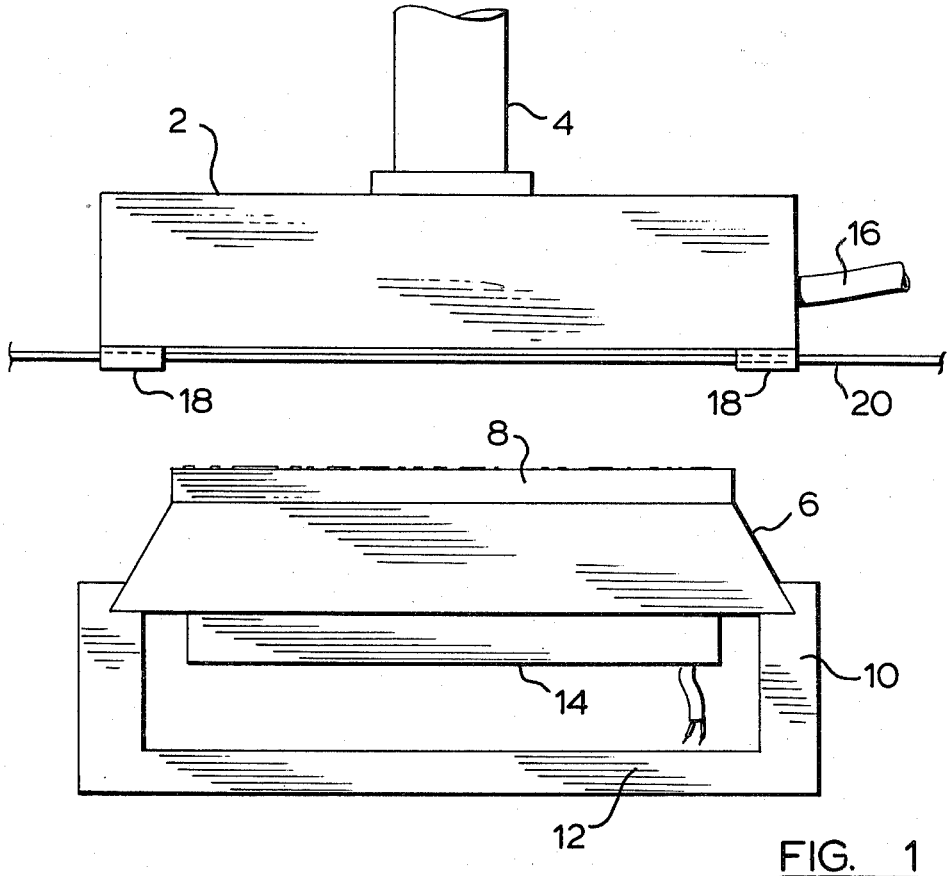
FIG. 1 is a diagrammatic side elevation of the relevant parts of a simple form of flat-bed press suitable for implementing the method of the invention.

Referring to FIG. 1, the press shown comprises a platen 2 vertically reciprocable by a ram 4, and a bed 6 on which a printing plate 8 is supported in thermal contact.

The bed is supported in blocks 10 on a base 12, and beneath the bed is a heating unit 14. This may conveniently be an electrical heating element, but a gas fired or other form of heater could be used provided that it is capable of raising the bed to a uniform temperature such that the surface of the printing plate 8 is above the carbonization temperature of the wood to be printed; a suitable temperature will generally be in the range 700°–800° F. and should be closely controlled to ensure uniform results. Moreover, the bed should have sufficient thickness and thermal capacity to ensure that the printing plate is uniformly heated: a heavy steel or cast iron bed is suitable. The printing plate may be of any material having adequate strenth and wear resistance at the high temperature employed -13 obviously low melting point type metals are unsuitable, but steel, which may be plated in known manner to increase its wear resistance, is a suitable material. The plates may be prepared using any known method for producing printing blocks that will withstand the necessary temperatures. The best results will generally be achieved using blocks which are duplicated in relief from wood-cuts or engravings.

The platen 2 may be of cast aluminum so as to provide high heat conductivity, and in order to ensure that it remains cool, water may be circulated through passages in the platen by means of hoses 16. The platen could be of copper, which would be more expensive, but metals of substantially lower heat conductivity than aluminum may not be able to absorb heat sufficiently rapidly. The platen also carries guides 18 at its opposite edges through which passes a continuos strip 20 of wood laminated to a non-woven fabric backing. After each lowering of the platen against the plate 8, the strip is indexed forward by means not shown in order to bring a fresh portion of the strip beneath the platen. The platen is lowered against the printing plate by the ram 4 for just long enough for the disign appearing in relief on the plate to be burned into the wood layer of the strip which is no more than a second or two: during this burning process, the backing and the lower portion of the wood are protected against burning by the cooling effect of the platen 2. The printed strip may either be guillotined into separate prints or maintained as a roll, for use for example as a wall covering. The guides 18 ensure that the strip is lifted away from the printing plate after each impression.

Figure 2:
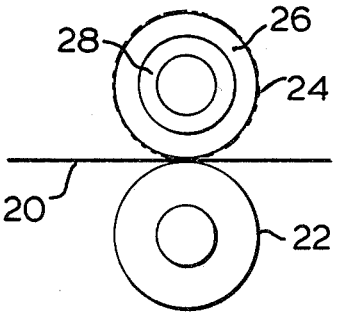
FIG. 2 is a diagram illustrating a simple form of rotary press for the same purpose.

FIG. 2 illustrates how a similar method can be carried out in a rotary press. Here the platen is in the form of a water cooled cylinder 22 and the printing plate 24 is mounted on an impression cylinder 26 incorporating a heating element 28. The cylinders 22 and 26 are rotated at a speed low enough relative to the temperature of the roller 26 to ensure the required impression being burned into the strip 20.

Figure 3:
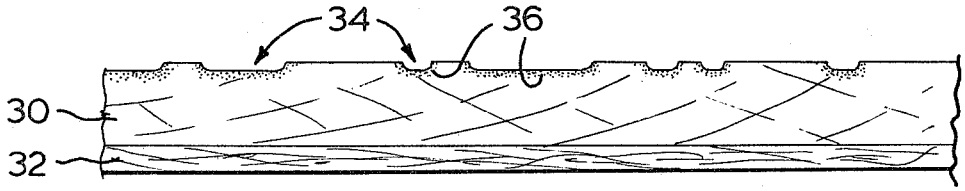
FIG. 3 is a greatly enlarged section of part of a pokerwork print produced by the method of the invention.

The strip 20 is shown in more detail in FIG. 3. It consists of a layer 30 of wood veneer bonded to a substrate 32 of paper or other non woven fabric, woven fabric or synthetic plastic or metal foil, either by the use of adhesive or by direct bonding if the material of the substrate is thermoplastic. A suitable material is sold under the trade mark Flexwood and comprises a very thin wood veneer adhesively bonded to a tough, thin paper substrate. With such a material, the paper layer may be printed with markings appropriate for postcards or the like, and also provides a satisfactory writing surface. The paper may be translucent so that the appearance of wood is preserved to some extent even on the rear of the card. The design burnt into the strip 20 by the printing plate is formed by depressions 34 in the free surface of the veneer, these indentations being surrounded by a layer 36 of partially carbonized wood.

Both the substrate layer and the wood layer may be very thin, thus producing a product which is thinner than known wood veneer postcards, and no thicker than a conventional postcard. Indeed, the thinness of the layers is an advantage, since the cooling of the strip from the rear sets up a steep temperature gradient in the laminate which provides very close control of the carbonization of the wood by the printing plate, preventing spreading and enabling fine detail to be achieved, and limiting the depth in the wood to which carbonization can extend. The substrate should be thin enough, relative to its thermal conductivity and the thickness and thermal conductivity of the wood, to enable heat to pass through it from the wood to the platen sufficiently fast that at least a significant portion of the thickness of the wood is always maintained below its carbonization temperature. Preferably the combined thickness of wood and substrate layers is about 0.015 inch to 0.02 inch, and the thickness of the substrate layer does not exceed about 0.002 inch. If the substrate is a thin, translucent paper, the grain of the wood is not unduly obscured, but its properties as a writing surface are greatly improved.

What I claim is:

1. A method of producing a pictorial design upon a wood veneer comprising the steps of: laminating one surface of the veneer onto a continuous thin substrate of paper, fabric or foil having a thickness of not more than about 0.002 inch to form a laminate having a combined thickness of about 0.015 inch to about 0.020 inch, impressing the other surface of the veneer with a desired pictorial design in a press having a printing plate bearing the design in relief and mounted on and in close thermal contact with a bed of substantial thermal capacity heated to a temperature above the carbonization temperature of the wood, locally carbonizing the one surface of the veneer in the locations in which it is impressed in intaglio with the design on the plate, and simultaneously holding a cold platen of high and uniform thermal conductivity in uninterrupted close thermal contact with the surface of said substrate opposite said printing plate to set up a temperature gradient in the laminate sufficient to limit the maximum impression of said design into the veneer.

2. A method according to claim 1, wherein the platen is water cooled.

3. A method according to claim 1, wherein the printing plate is maintained at 700°–800° F.

4. A method according to claim 1, wherein both the bed and the platen are rotating cylinders.

* * * * *